United States Patent [19]

Huber et al.

[11] 4,076,672

[45] Feb. 28, 1978

[54] LUBRICANTS FOR ORGANIC FIBRES

[75] Inventors: Peter Huber; Helga Lampelzammer; Ewald Pirson; Franz Wimmer, all of Burghausen, Germany

[73] Assignee: Wacker-Chemie GmbH, Munich, Germany

[21] Appl. No.: 709,700

[22] Filed: Jul. 29, 1976

[30] Foreign Application Priority Data

Aug. 11, 1975 Germany ..... 2535768

[51] Int. Cl.[2] ..... C08J 3/00

[52] U.S. Cl. ..... 260/29.2 M; 252/8.6; 260/827; 428/266

[58] Field of Search ..... 252/8.6; 428/266; 260/29.2 M, 827

[56] References Cited

U.S. PATENT DOCUMENTS

| | | | |
|---|---|---|---|
| 3,345,424 | 10/1967 | Hauptschein et al. | 252/8.6 |
| 3,493,425 | 2/1970 | Campbell | 252/8.6 |
| 3,896,032 | 7/1975 | Stroh et al. | 252/8.6 |
| 3,929,721 | 12/1975 | Leverett | 260/827 |
| 3,983,272 | 9/1976 | Huber et al. | 252/8.6 |
| 4,010,136 | 3/1977 | Blizzard et al. | 260/827 |

FOREIGN PATENT DOCUMENTS

| | | |
|---|---|---|
| 1,588,307 | 4/1970 | France. |

*Primary Examiner*—William E. Schulz

[57] ABSTRACT

A composition containing a mixture of (a) an aqueous emulsion obtained from the emulsion polymerization of a diorganopolysiloxane having an average viscosity of at least 20,000 cSt at 25° C and component (b) which is selected from the class consisting of (i) a paraffin wax, (ii) a perfluoropolymer in which some of the fluoro groups may be substituted with chlorine atoms and mixtures thereof. The composition is applied as a lubricant to organic fibres to improve their slip properties.

11 Claims, No Drawings

LUBRICANTS FOR ORGANIC FIBRES

The present invention relates to a composition which imparts improved lubricity to fibres treated therewith and to a method for preparing the same.

It is often desired to impart increased slip to organic fibres in order to reduce the tendency of the fibres to break, tear or even melt when under tension in, for example, a high-speed sewing machine or a weaving loom. Diorganopolysiloxanes, especially dimethylpolysiloxanes, either alone or in admixture with organic oils or waxes, have been used as lubricants for treating fibres in order to improve their slip properties (cf. British Patent Specification No. 1 394 610). Many of these compositions contain organic solvents which are fire and health hazards. Also aqueous emulsions of diorganopolysiloxanes, which are produced by emulsion polymerization, have been used as lubricants (cf. British Patent Specification No. 1 227 795); however, they are unstable and impart poor lubricity to fibres treated therewith.

Therefore it is an object of this invention to provide a composition which will impart improved lubricity to organic fibres treated therewith. Still another object of this invention is to provide a composition which is free of organic solvents. A further object of this invention is to provide a stable dispersion which may be applied to organic fibres.

The foregoing objects and others which will become apparent from the following description are accomplished in accordance with this invention, generally speaking, by coating organic fibres with a composition containing a mixture of (a) an aqueous emulsion obtained from the emulsion polymerization of a diorganopolysiloxane having an average viscosity of at least 20,000 cSt at 25° C, and component (b) in which (b) is selected from the class consisting of (i) a paraffin wax, (ii) a perfluoropolymer in which some of the fluoro groups may be substituted with chlorine atoms and mixtures thereof.

The lubricant of this invention has many advantages over the lubricants described heretofore. For example, it contains no organic liquids, thus, its use does not involve the risk of fire, explosion, unpleasant smells and health hazards. Also the lubricant may be easily prepared with little expenditure for equipment and it is a stable dispersion. Moreover, it imparts an increased lubricity or slip to the treated fibres so that they may be sewn and processed more easily.

The diorganopolysiloxane employed in the emulsion is preferably represented by the general formula $$HO—(SiR_2O)_p—H$$

and, or $$R_3SiO—(SiR_2O)_p—SiR_3$$

in which each R represents a monovalent, unsubstituted or substituted hydrocarbon radical and $p$ represents an integer such that the diorganopolysiloxane has an average viscosity of at least 20,000 cSt at 25° C. The diorganopolysiloxane represented above may also contain up to 10 mole percent of siloxane units other than diorganosiloxane units and triorganosiloxane units, such as, for example, units of the formulae $RSiO_{3/2}$ and $SiO_{4/2}$. Such units are generally present only as impurities.

Examples of radicals represented by R are alkyl radicals having up to 5 carbon atoms, e.g., methyl, ethyl, n-propyl, isopropyl, n-butyl, sec-butyl, n-pentyl and sec-pentyl radicals; aryl radicals, e.g., phenyl radicals; halohydrocarbon radicals, e.g., 3,3,3-trifluoropropyl radicals and (o, m or p)-chlorophenyl radicals; and aminohydrocarbon radicals, e.g., N-(beta-aminoethyl)-gamma-aminopropyl radicals. It is preferred that at least 50 mole percent of the silicon-bonded organic radicals, namely the radicals represented by $R_3$, in the diorganopolysiloxane are methyl radicals, since these are more readily available.

The viscosity of the diorganopolysiloxane preferably does not exceed about $3 \times 10^6$ cSt at 25° C.

The diorganopolysiloxane is prepared by an emulsion polymerization process and the aqueous diorganopolysiloxane emulsion obtained from such a process is used in preparing the lubricant in accordance with this invention. Suitable emulsion polymerization processes are described in, for example, German Offenlegungsschriften Nos. 1 495 512, 1 570 451 and 1 595 535 and in British Patent Specifications Nos. 1 227 795 and 1 228 527.

The diorganopolysiloxane may be manufactured by polymerizing, in aqueous emulsion, a diorganopolysiloxane represented by the general formula $$(HO)_x—(SiR_2O)_n—H_x$$

either alone or in admixture with a diorganopolysiloxane represented by the general formula $$R_3SiO—(SiR_2O)_m—SiR_3$$

in which formulae R is the same as above, $x$ represents 0 or 1, $n$ represents an integer of from 3 to 500, with the provision that when $x$ represents 0, $n$ represents 3, 4 or 5, and $m$ represents a positive integer.

The polymerization is preferably carried out using a catalyst of the general formula $$R^1SO_3H$$

in which $R^1$ represents an alkyl radical having from 6 to 18 carbon atoms or an alkaryl radical in which the alkyl group has from 6 to 18 carbon atoms. Examples of such catalysts are dodecylbenzenesulphonic acid, hexylsulphonic acid, dodecylsulphonic acid, octadecylsulphonic acid, butylnaphthalenesulphonic acid and nonylnaphthalenesulphonic acid. The catalyst may be used in an amount of from 0.1 to 5 percent by weight, based on the weight of the diorganopolysiloxane to be polymerized.

When the polymerization has been carried out to the desired degree, that is to say when the diorganopolysiloxane has attained the desired viscosity, the catalyst may be neutralized by adding a basic compound, for example ammonium hydroxide, sodium hydroxide, potassium carbonate, sodium carbonate, or an amine, e.g., ethanolamine.

The polymerization may also be carried out using an ion exchange resin instead of the above-mentioned catalyst.

The emulsifier used for the polymerization may be an anionic or a non-ionic emulsifier. A protective colloid may also be used.

Polymerization is preferably carried out at room temperature and at atmospheric pressure, although a higher temperature and a higher or lower pressure may be used.

The aqueous emulsion resulting from the polymerization may simply be mixed with component (b), in order to prepare the lubricant described in this invention. Alternatively and preferably, however, the polymerization may be effected in the presence of component (b) in the desired amount, in which case the aqueous emulsion resulting from the polymerization is ready for use as the lubricant in accordance with this invention. In the latter case, the emulsifier is generally used in an amount of up to 5 percent by weight, based on the weight of the polymerization mixture.

The paraffin wax used as component (b)(i) may be a natural paraffin wax or a synthetic paraffin wax. Preferably, the paraffin wax has a melting range of from 30° to 80° C, and more preferably from 45° to 65° C. It is preferred to use a refined paraffin wax (white, free of odor and the oil content is about 0.5 percent by weight) or a semi-refined paraffin wax (off-white, slight odor and an oil content of from 1.0 to 2.5 percent by weight). (These paraffin waxes are described in "Ullmanns Encyklopadie der technischen Chemie", Munich - Berlin - Vienna 1967, vol. 18, page 274). A mixture of paraffin waxes may also be used.

Component (b)(ii) is a perfluoropolymer which may contain chlorine atoms, that is to say a polymer consisting wholly of carbon, fluorine and, optionally, chlorine atoms. The perfluoropolymer may be polytrifluorochloroethylene or, preferably, polytetrafluoroethylene. The perfluoropolymer preferably has a molecular weight in the range of from $10^5$ to $5 \times 10^6$, and an average particle size within the range of from 0.1 to 0.5 micron.

The lubricant preferably contains the diorganopolysiloxane, component (a), in an amount within the range of from 5 to 60 percent by weight, based on the diorganopolysiloxane and water. The lubricant preferably contains component (b), that is to say the paraffin wax, (b)(i), and/or the perfluoropolymer (b)(ii), in an amount within the range of from 1 to 70 percent by weight, and more preferably from 10 to 50 percent by weight, based on the weight of components (a) and (b). The lubricant may additionally contain the various polymerization additives mentioned above, e.g., neutralized catalyst or ion exchange resin, anionic or nonionic emulsifier, and protective colloid. Generally it will not contain an organic solvent since this is an advantage of the present lubricant over that known in the art.

Organic fibres that may be treated with the lubricant in accordance with this invention are natural fibres, for example, wool, cotton, rayon, hemp or silk, or synthetic fibres, for example, those of polypropylene, polyethylene, polyester, polyurethanes, polyamines, cellulose acetate or polyacrylonitrile, as well as mixtures of two or more of such materials. The fibres are preferably in the form of single threads or yarns or of multiple, mostly treble, twisted threads or yarns. The fibres may, however be in the form of untwisted threads, fleeces, mats, or woven or knitted textiles, including articles of clothing.

The lubricant may be applied to the fibres in any suitable manner known in the art, such as by spraying, immersing, roll coating, or by passing the fibres over a support impregnated with the lubricant.

Various examples and comparison examples have been carried out in order to further illustrate the preparation and use of the lubricants in accordance with this invention and to compare them with other lubricants for organic fibres.

The lubricants used in the respective examples and comparison examples were prepared in the following manner in which all parts are by weight unless otherwise specified.

EXAMPLE 1

A mixture containing 4 kg of a hydroxy-terminated dimethylpolysiloxane (viscosity 145 cSt at 25° C) and 1 kg of refined paraffin wax (54° to 56° C) was heated to 80° C and, when the wax had melted, was homogenized in a homogenizer under a pressure of 280 kg/cm$^2$. The mixture obtained was then homogenized in the same apparatus with 200 g of water, 250 g of a non-ionic emulsifier (nonylphenol and ethylene oxide in a molar ratio of 1:23), and a solution of 200 g of dodecylbenzenesulphonic acid in 500 g of water, under a pressure of 280 kg/cm$^2$. When a homogeneous mixture had been obtained, it was diluted with 3.8 kg of water, again under a pressure of 280 kg/cm$^2$. The resulting dispersion was stored at room temperature for 36 hours, after which its pH was adjusted to 7 with dilute sodium hydroxide solution.

The dispersion was very stable. The dimethylpolysiloxane in the dispersion had a viscosity of $10^5$ cSt at 25° C. The dispersion contained 50 percent by weight of dispersed materials. The weight ratio of dimethylpolysiloxane to paraffin was 4:1, and the dispersed particles were from 0.05 to 0.2 micron.

EXAMPLE 2

About 500 g of a hydroxy-terminated dimethylpolysiloxane (viscosity 120 cSt at 25° C), 90 g of dodecylbenzenesulphonic acid, and 100 g of water were mixed in a high-speed mixing apparatus. While stirring, 350 g of a 60 percent by weight aqueous suspension of polytetrafluoroethylene (molecular weight $10^6$, particle size 0.1 to 0.5 micron) were added. When a homogeneous mixture had been obtained, 642 g of water were added, with agitation. The dispersion was then stored for 8 hours at room temperature, after which its pH was adjusted to 7 with 18 g ethanolamine.

The resulting dispersion was very stable and contained fine particles. It contained 50 percent by weight of dispersed materials, with a weight ratio of dimethylpolysiloxane to polytetrafluoroethylene of 5:2.1. The dimethylpolysiloxane had a viscosity of $10^5$ cSt at 25° C.

EXAMPLE 3

A dispersion was prepared in accordance with the procedure described in Example 2, except that the following amounts of the respective components were used:

750 g of the dimethylpolysiloxane,
135 g of dodecylbenzenesulphonic acid,
150 g of water,
166 g of the polytetrafluoroethylene suspension, and
500 g of water.

The dispersion was stored at room temperature for 3.5 hours, after which its pH was adjusted to 7 with dilute sodium hydroxide solution.

The dispersion thus obtained was stable and contained fine particles. Its solids content was 50 percent by weight, and the weight ratio of dimethylpolysiloxane to polytetrafluoroethylene was 7.5:1. The dimethylpolysiloxane had a viscosity of 50,000 cSt at 25° C.

EXAMPLE 4

A mixture containing 300 g of a dimethylpolysiloxane (Example 1) and 200 g of refined paraffin wax (Example 1) was heated to 80° C and introduced into a high-speed mixing apparatus. When the wax had melted, the mixture was homogenized and then, while still stirring, 25 g of a non-ionic emulsifier (Example 1) and a solution of 20 g of dodecylbenzenesulphonic acid in 70 g of water at 80° C, were added. When this mixture was homogeneous, 380 ml of water were added, with agitation. The dispersion thus obtained was stored at room temperature for 3 hours, after which its pH was adjusted to 7 with ethanolamine.

The resulting dispersion was stable and contained 50 percent by weight of dispersed particles, which had a diameter of 0.05 to 0.2 micron. The weight ratio of dimethylpolysiloxane to paraffin wax was 3:2. The dimethylpolysiloxane had a viscosity of 20,000 cSt at 25° C.

Comparison Example C1

About 4 kg of a dimethylpolysiloxane (Example 1), 200 g of a non-ionic emulsifier (Example 1), a solution of 160 g of dodecylbenzenesulphonic acid in 400 g of water, and 200 g of water were homogenized in a homogenizer under a pressure of 280 kg/cm$^2$. When the mixture was homogeneous, 3.8 kg of water were added, again under a pressure of 280 kg/cm$^2$. The dispersion was stored for 10 minutes at room temperature and then adjusted to pH 7 with dilute sodium hydroxide solution.

The dimethylpolysiloxane in the resulting dispersion had a viscosity of $10^3$ cSt at 25° C. The solids content of the dispersion was 35 percent by weight.

Comparison Example C2

The procedure of Comparison Example C1 was repeated, except that the dispersion was stored for 2.5 hours instead of 10 minutes.

The dimethylpolysiloxane had a viscosity of 20,000 cSt at 25° C. The solids content was the same as in Comparison Example C1.

Comparison Example C3

The procedure of Comparison Example C1 was repeated, except that the dispersion was stored for 6 hours instead of 10 minutes.

The dimethylpolysiloxane had a viscosity of $10^5$ cSt at 25° C. The solids content was the same as in Comparison Example C1.

Comparison Example C4

The procedure of Comparison Example C1 was repeated, except that the dispersion was stored for 24 hours instead of 10 minutes.

The dimethylpolysiloxane had a viscosity of $10^6$ cSt at 25° C. The solids content was the same as in Comparison Example C1.

Comparison Example C5

(a) About 500 g of refined paraffin wax (Example 1) were heated to 80° C in a mixing apparatus and then 50 g of a non-ionic emulsifier (Example 1) and 50 g of water at 80° C were aded. When the mixture was homogeneous, it was diluted while agitating with 400 ml of water.

(b) About 500 g of a hydroxy-terminated dimethylpolysiloxane (viscosity 350 cSt at 25° C) were mixed with 50 g of a non-ionic emulsifier (Example 1) and 50 g of water in a high-speed mixing apparatus. The uniform mixture thus obtained was diluted while agitating with 400 ml of water.

(c) The paraffin wax emulsion prepared in (a) above and the dimethylpolysiloxane emulsion prepared in (b) above were mixed in such proportions as to give an emulsion containing 4 parts by weight of the dimethylpolysiloxane to 1 part by weight of the paraffin wax and a total of 50 percent of dispersed material.

Comparison Example C6

The procedure of Comparison Example C5 was repeated, except that 500 g of a hydroxy-terminated dimethylpolysiloxane having a viscosity of 15,000 cSt at 25° C were used instead of the dimethylpolysiloxane having a viscosity of 350 cSt at 25° C.

Comparison Example C7

The procedure of Comparison Example C5 was repeated, except that 500 g of a hydroxy-terminated dimethylpolysiloxane having a viscosity of 50,000 cSt at 25° C were used instead of the dimethylpolysiloxane having a viscosity of 350 cSt at 25° C.

Comparison Example C8

The dimethylpolysiloxane emulsion prepared in Comparison Example C5 (b) above was mixed with a 60 percent aqueous suspension of polytetrafluoroethylene (Example 2) in such proportions as to give a mixed emulsion containing 6 parts by weight of the dimethylpolysiloxane per 1 part by weight of the polytetraflurorethylene.

Comparison Example C9

The procedure of Comparison Example C8 was repeated, except that 500 g of the dimethylpolysilxoane specified in Comparison Example C6 were used instead of the dimethylpolysiloxane specified in Comparison Example C5.

Tests

Each of the lubricants prepared in accordance with Examples 1 to 4 and Comparison Examples C1 to C6 was applied, respectively, to 500 meters of white yarn from a treble-twisted polyester staple fibre available under the Trademark "Mara" from Messrs. Gutermann, Federal Republic of Germany (100 meters of untwisted yarn weighed 1 g). Application was effected by passing the yarn over a roller partially immersed in a vat containing the respective lubricant. The yarn was then wound onto a reel, using a cross-winding machine of the type known as "Pramat-Junior K" and available from Messrs. Sahm, Eschwege, Federal Republic of Germany.

Four layers of blue cotton twill (overall material) were then sewn with the treated yarns at the rate of 7000 stitches per minute, using an industrial sewing machine of the type "438" from Messrs. Pfaff, Federal Republic of Germany, while using a thread tensioning device (from Messrs. Schmidt, Weldkraiburg, Federal Republic of Germany).

The thread tension and the average seam length at which the yarn tore or melted, after repeating the sewing process at least 5 times, were determined as a measure of the degree of slip imparted to the yarn by the lubricant. The extent of absorption of the lubricant by the yarn was also determined. The results are illustrated in the following table.

TABLE

| Ex. | Lubricant Component (a) viscosity (cSt at 25° C) | Component (b) | Absorption by yarn (% by weight) | Thread Tension (g) | seam Length (cm) |
|---|---|---|---|---|---|
| 1 | 100,000 | paraffin wax | 1.3 | 370 - 400 | 25.9 |
| 2 | 100,000 | PTFE | 1.1 | 380 -390 | 22.7 |
| 3 | 50,000 | PTFE | 1.4 | 350 -370 | 23.8 |
| 4 | 20,000 | paraffin wax | 2.9 | 420 -430 | 19.4 |
| C1 | 1,000 | none | 1.2 | 500 - 800 | 7.6 |
| C2 | 20,000 | none | 3.5 | 500 - 600 | 13.4 |
| C3 | 100,000 | none | 1.2 | 500 - 600 | 17.8 |
| C4 | 1,000,000 | none | 1.1 | 450 - 500 | 15.7 |
| C5 | 350 | paraffin wax | 1.3 | 450 - 700 | 8.3 |
| C6 | 15,000 | paraffin wax | 1.7 | 430 - 570 | 11.7 |

PTFE - Polytetrafluoroethylene

The emulsions obtained in Comparison Examples C7 to C9 were too unstable to be applied to the yarn.

It can be seen from the results in the Table that the slip imparted to the yarn by the lubricant of this invention is better than that imparted by an aqueous emulsion, prepared by emulsion polymerization of a dimethylpolysiloxane of the same or similar viscosity in the absence of component (b) (Comparison Examples C1 to C4). It is also better than that imparted by an aqueous emulsion of a dimethylpolysiloxane polymerized before emulsification, containing component (b). Comparison Examples C7 to C9 show that certain emulsions of a dimethylpolysiloxane, polymerized before emulsification, containing component (b) are not of sufficient stability that they can be used as lubricants.

Although specific examples of the invention have been described herein it is not intended to limit the invention solely thereto, but to include all the variations and modifications falling within the scope of the appended claims.

What is claimed is:

1. A process for preparing a lubricant for organic fibers which comprises polymerizing an aqueous emulsion of (a) a diorganopolysiloxane having the general formula $$(HO)_x—(SiR_2O)_n—H_x$$

in which each R is selected from the class consisting of an alkyl radical having up to 5 carbon atoms, a phenyl radical, a halohydrocarbon radical and an aminohydrocarbon radical, $x$ is 0 or 1 and $n$ is an integer of from 3 to 500, with the provision that when $x$ is 0, $n$ is 3, 4 or 5, in the presence of component (b) which is selected from the class consisting of (i) a paraffin wax (ii) polytetrafluoroethylene and (iii) polytrifluorochloroethylene, in which component (b) is present in an amount of from 1 to 70 percent by weight based on the weight of components (a) and (b) to form an aqeuous emulsion in which the diorganopolysiloxane has a viscosity of at least 20,000 cSt at 25° C.

2. The process of claim 1, wherein the diorganopolysiloxane is admixed with a diorganopolysiloxane of the general formula $$R_3SiO—(SiR_2O)_m—SiR_3$$

in which R is selected from the class consisting of an alkyl radical having up to 5 carbon atoms, a phenyl radical, a halohydrocarbon radical and an aminohydrocarbon radical and $m$ is a positive integer.

3. The process of claim 1, wherein the polymerization is conducted in the presence of a catalyst having the general formula $$R^1SO_3H$$

in which $R^1$is selected from the class consisting of an alkyl radical having from 6 to 18 carbon atoms and an alkaryl radical in which the alkyl group has from 6 to 18 carbon atoms.

4. The process of claim 3, wherein the catalyst is used in an amount of from 0.1 to 5 percent by weight, based on the weight of the diorganopolysiloxane.

5. The process of claim 3, wherein the catalyst is neutralized by adding a basic compound after the polymerization has been completed.

6. The process of claim 1, wherein the polymerization is conducted in the presence of an ion-exchange resin.

7. The process of claim 3, wherein the polymerization is conducted in the presence of up to 5 percent by weight, based on the polymerization mixture, of an anionic or non-ionic emulsifier.

8. Organic fibres treated with the lubricant prepared in accordance with the process of claim 1.

9. The process of claim 1, wherein the paraffin wax has a melting range of from 30° to 80° C.

10. The process of claim 1, wherein the fluoropolymers have a molecular weight of $10^5$ to $5 \times 10^6$.

11. The process of claim 1, wherein the fluoropolymers have an average particle size of from 0.1 to 0.5 micron.

* * * * *